US009034067B2

(12) United States Patent
Chen

(10) Patent No.: US 9,034,067 B2
(45) Date of Patent: May 19, 2015

(54) CYCLONE SEPARATING APPARATUS OF VACUUM CLEANER

(71) Applicant: Yuyao Jingcheng High & New Technology Co., Ltd., Yuyao, Zhejiang (CN)

(72) Inventor: Guozhang Chen, Zhejiang (CN)

(73) Assignee: Yuyao Jingcheng High & New Technology Co., Ltd., Yuyao, Zhejiang (CN)

( * ) Notice: Subject to any disclaimer, the term of this patent is extended or adjusted under 35 U.S.C. 154(b) by 0 days.

(21) Appl. No.: 13/921,632

(22) Filed: Jun. 19, 2013

(65) Prior Publication Data

US 2014/0090341 A1 Apr. 3, 2014

(30) Foreign Application Priority Data

Sep. 29, 2012 (CN) ..... 2012 2 05113981 U

(51) Int. Cl.
*B01D 45/12* (2006.01)
*A47L 9/16* (2006.01)

(52) U.S. Cl.
CPC ..... *A47L 9/1641* (2013.01); *A47L 9/1625* (2013.01); *A47L 9/1666* (2013.01); *A47L 9/1683* (2013.01); *A47L 9/1691* (2013.01)

(58) Field of Classification Search
CPC ... A47L 9/1641; A47L 9/1683; A47L 9/1666; A47L 9/1625; A47L 9/1608
USPC ..... 55/346, 459.1, 337, 345, 343, 424, 426, 55/428, 429, DIG. 3; 15/353
See application file for complete search history.

(56) References Cited

U.S. PATENT DOCUMENTS

2005/0102982 A1* 5/2005 Dummelow et al. ..... 55/428
2006/0230717 A1* 10/2006 Oh et al. ..... 55/343
2009/0235482 A1* 9/2009 Tanner et al. ..... 15/353

* cited by examiner

*Primary Examiner* — Dung H Bui
(74) *Attorney, Agent, or Firm* — Stites & Harbison PLLC; Cong Ding

(57) ABSTRACT

A multi-cyclone separating apparatus of vacuum cleaner comprises a upstream cyclone forming upstream separating chamber inside, downstream cyclones at least one of which forming downstream separating chamber inside, the upper part of the upstream cyclone chamber is connected with an air inlet passage, said upstream cyclone has a upstream guide air intake inside, the downstream cyclone has a downstream air intake and the downstream cyclone has a downstream guide outlet inside, an air passage is formed between upstream guide air intake and downstream guide outlet which connected with the two. The multi-cyclone separating apparatus also comprises an outer cyclone body, the upstream cyclone is located inside of the outer cyclone body and the entrance of air inlet passage is located at the outer cyclone body or extend to the outside of the outer cyclone body.

6 Claims, 4 Drawing Sheets

B–B

C–C

CYCLONE SEPARATING APPARATUS OF VACUUM CLEANER

CROSS REFERENCE TO RELATED APPLICATIONS

This application claims the benefit of People's Republic of China application Serial No. 2012205113981 filed on Sep. 29, 2012, under 35 USC Sec. 119(a) hereby specifically incorporated by reference in its entirely.

FIELD OF THE INVENTION

The invention relates to a dust collector of a vacuum cleaner, especially to a multi-cyclone separating apparatus.

DESCRIPTION OF THE RELATED ART

In prior art, a multi-cyclone separator for a vacuum cleaner comprises an upstream cyclone separator and a downstream cyclone separator or a plurality of downstream cyclone separators surrounding the upstream cyclone separator. A primary dust chamber is formed under the upstream cyclone separator for collecting big dust separated by the upstream cyclone separator. A secondary dust chamber is formed under the downstream cyclone separator for collecting the small dust separated by the downstream cyclone separator. The secondary dust chamber is outside and surrounds the primary dust chamber. The problem of this establishment is that the volume of primary dust chamber is rather small. Whereas the size of the dust dropped into the primary dust chamber is big, the primary dust chamber becomes full easily in use and influences the ability of continuous dust suction of the vacuum cleaner.

SUMMARY OF THE INVENTION

The present invention is to provide a multi-cyclone separating apparatus of vacuum cleaner having high efficiency of dust separating and strong ability of continuous dust suction.

For this purpose, the following technical solution is disclosed in this invention: a multi-cyclone separating apparatus of vacuum cleaner comprising an upstream cyclone wherein an upstream separating chamber is formed inside, and at least one downstream cyclone inside each of which is formed a downstream separating chamber, wherein the upper portion of the upstream cyclone chamber is connected with an air inlet passage, the upstream cyclone has an upstream air outlet in its interior, and the downstream cyclone has a downstream air inlet and a downstream air outlet inside. Between the upstream air outlet and the downstream air inlet an air passage is formed and connected with both of the two. The multi-cyclone separating apparatus also comprises an outer barrel, inside of which the upstream cyclone is located. The entrance of the air inlet passage is set on the outer barrel or extends to the outside of the outer barrel. The outer barrel also comprises a shielding cover inside which is formed a secondary dust chamber. A primary dust chamber is formed between the outside wall of the shielding cover and the outer barrel. Along the circumferential direction of the upstream cyclone, a curved dust rejecting mouth is set in the bottom of upstream cyclone near its side wall, which is entirely in the outside of the shielding cover. The primary dust chamber is under the dust rejecting mouth and connected with it. A downstream dust hole is set in the bottom of the downstream cyclone, which is inside the shielding cover and connected with the secondary dust chamber. The big dust separated by the upstream cyclone drops into the primary dust chamber which is outside the shielding cover, while the small dust separated by downstream cyclone drops into the secondary dust chamber which is inside the shielding cover. The primary dust chamber is separated from the secondary dust chamber by the shielding cover.

In a preferred embodiment, the lower part of the downstream cyclone forms a cone tapering from top to bottom, and the lower part of the downstream cyclone is arranged beside the upstream cyclone while the upper part is located above the upstream cyclone, which makes the distribution of inner parts of the separating apparatus more reasonable and the inner structure more compact.

In a more preferred embodiment, a plurality of downstream cyclones is provided. More preferably, the downstream cyclones are arranged along a circumferential the axis of which coincides with the axis of the outer barrel, while the axis of the upstream cyclone is at a distance away from the axis of the outer barrel.

In some embodiments, the upper end of the shielding cover is connected to the undersurface of the upstream cyclone and the outer wall of the downstream cyclone. The lower part of downstream cyclone is situated inside the shielding cover.

In some certain embodiments, the undersurface of the downstream cyclone is inclined in such a way that it inclines downward from the near to the distant to the longitudinal axis of the shielding cover. The downstream dust hole is opened on the inclined undersurface of the downstream cyclone. The inclination of the undersurface makes the downstream dust hole incline towards the longitudinal axis of the secondary dust chamber, which makes the dust separated by the downstream cyclone be rejected along a direction towards the inside of the shielding cover to improve the dust separating efficiency.

In a preferred embodiment, there is an angle Q that is greater than 0° and less than 90° between a line perpendicular to the undersurface of the downstream cyclone and the longitudinal axis of the shielding cover.

More preferably, the angle Q is greater than 45° and less than 60°.

In some embodiments, the upstream cyclone has a hollow column with a taper-shaped grid, and the inner chamber of the hollow column forms an upstream air-exhausting passage connected with the upstream air outlet.

Due to the invention described above, since primary dust chamber collecting big dust is outside and secondary dust chamber is inside, the volume of primary dust chamber could be bigger relatively while the volume of secondary dust chamber could be smaller relatively, which just meet the distributing needs that big dust is in large quantity whose volume is bigger and small dust is in little quantity whose volume is smaller. Thus the dust chamber inside of separating apparatus is not easy be full and it is longer to suck dust efficiently and constantly.

Wherein, 10. outer barrel; 101. primary dust chamber; 11. upper cover; 110. air outlet; 111. handle; 12. air inlet passage; 20. upstream cyclone; 201. upstream separating chamber; 21. hollow column; 211. taper-shape grid; 22. dust rejecting mouth; 23 upstream air outlet; 30. downstream cyclone; 301. downstream separating chamber; 31. downstream air inlet; 32. downstream dust hole; 33. downstream air outlet; 40. shielding cover; 401. secondary dust chamber.

PREFERRED DESCRIPTION OF THE INVENTION

Figure 1:
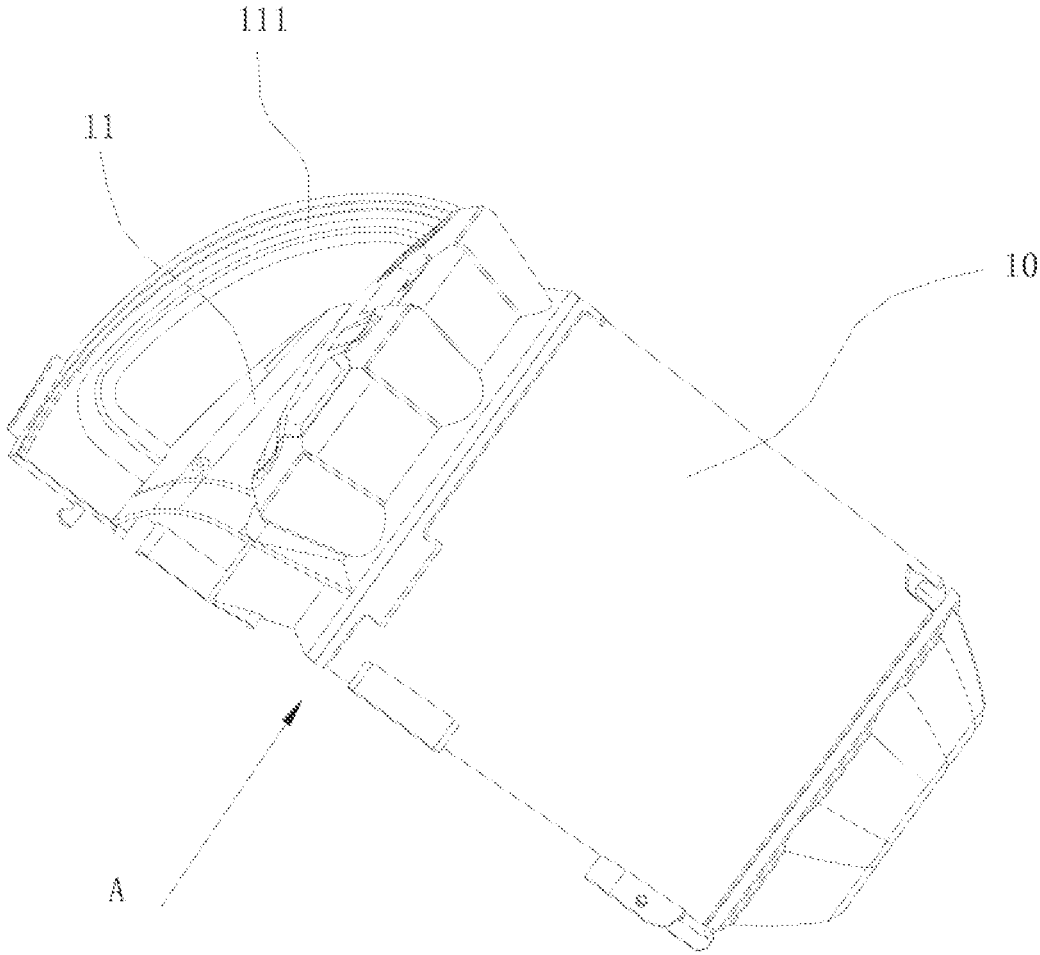
FIG. 1 is a side view of a cyclone separating apparatus according to the invention.
Figure 2:
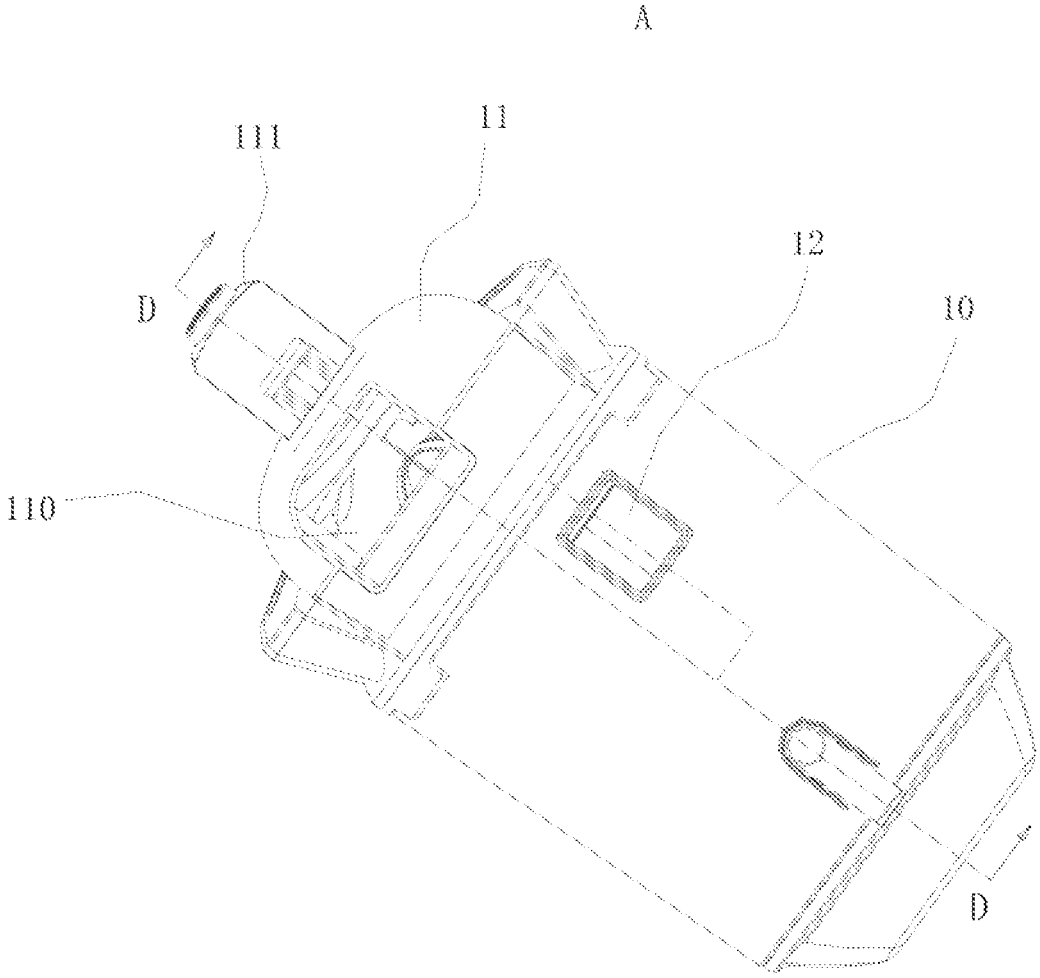
FIG. 2 is a view of the cyclone separating apparatus along the A direction in FIG. 1.

As shown in FIG. 1 and FIG. 2, the multi-cyclone separating apparatus comprises an outer barrel 10 having a gap. An air inlet passage 12 which would be introduced hereinafter is formed from the gap extending inward the outer barrel 10.

There is an upper cover 11 set on the outer barrel 10 and the upper cover 11 has a handle 111 convenient for taking, the upper cover 11 has an air outlet 110 to be connected with a negative pressure source of a vacuum cleaner utilizing the multi-cyclone separating apparatus according to the present invention.

Figure 3:
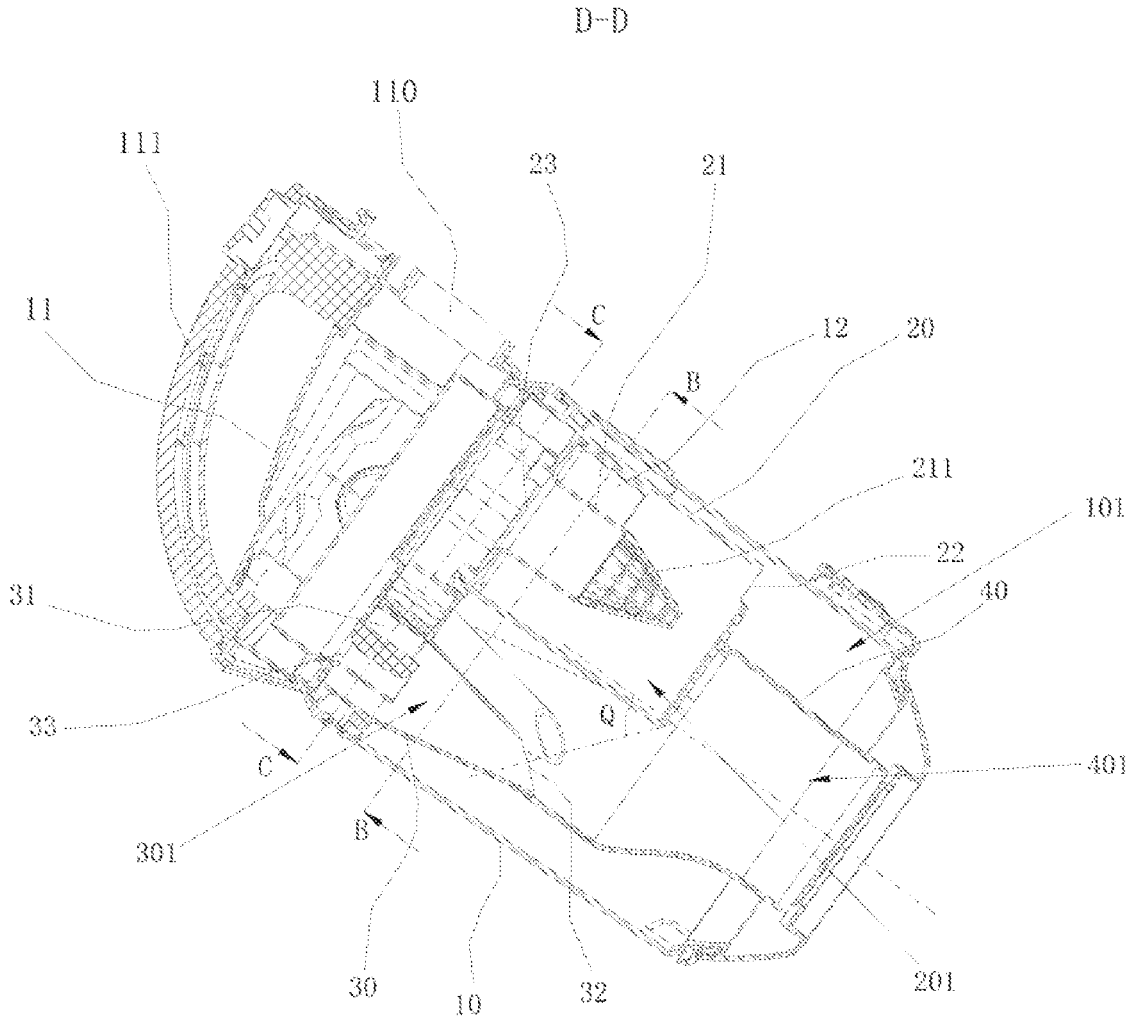
FIG. 3 is a section view of the cyclone separating apparatus along the D-D direction in FIG. 2. The cyclone separating apparatus in FIG. 1 to FIG. 3 is tilting to match its titling state in actual practice, which is beneficial to show the structure of the cyclone separating apparatus according to the invention aptly.

As show in FIG. 3, it reflects the inner structure of the multi-cyclone separating apparatus. The multi-cyclone separating apparatus of vacuum cleaner comprising upstream cyclone 20 forming upstream separating chamber 201 inside, downstream cyclone 30 at least one of which forming downstream separating chamber 301 inside, upstream cyclone 20 is inside of the outer barrel 10. The upper part of upstream separating chamber 201 is connected with the air inlet passage 12 above-mentioned, except the way above-mentioned that the entrance of air inlet passage 12 is located at the outer barrel 10, it also could extends to the outside of the outer barrel. Upstream cyclone 20 has an upstream air outlet 23 inside, downstream cyclone 30 has a downstream air inlet 31 and downstream cyclone has a downstream air outlet 33 inside, an air passage is formed between the upstream air outlet 23 and the downstream air outlet 33 which connected with the two.

Upstream cyclone 20 has a hollow column 21 with taper-shape grid 211, and the inner chamber of the hollow column 21 forms the upstream air-exhausting passage connected with upstream guide air outlet 23.

Besides, the outer barrel 10 also comprises shielding cover 40 inside. In the preferred embodiment shown in FIG. 3, the upper end of shielding cover 40 is connected with the undersurface of upstream cyclone 20 and the outer wall of downstream cyclone 30, the lower part of downstream cyclone 30 is inside of shielding cover 40. The secondary dust chamber 401 is formed inside of the shielding cover 40, and the primary dust chamber 101 is formed between the outside wall of shielding cover 40 and the outer barrel 10. Along the circumferential direction of the upstream cyclone 20, curved dust rejecting mouth 22 is set in the bottom of upstream cyclone 20 near its side wall, which is in the outside of shielding cover 40 entirely, primary dust chamber 101 is under the dust rejecting mouth 22 and connected with it; downstream dust hole 32 is set in the bottom of downstream cyclone 30, which is inside of shielding cover 40 and connected with secondary dust chamber 401.

According to the structure above-description, the work procedure of this multi-cyclone separating apparatus is as bellow: air flow with dust enter into upstream separating chamber 201 though air inlet passage 12, most of dust is throw out from dust rejecting mouth 22 after separating in upstream separating chamber 201 and drop into primary dust chamber 101, airflow with few small dust exhaust from the upstream air outlet 23 then enter into downstream cyclone 30 though upstream air intake 31, airflow with dust is separated again in the downstream separating chamber 301 of downstream cyclone 30, the small dust separated drop out from downstream dust hole 32 and then enter into secondary dust chamber 401, clean airflow exhaust from the downstream air outlet 33, and finally enter into the negative pressure source of vacuum cleaner though air outlet.

Figure 4:
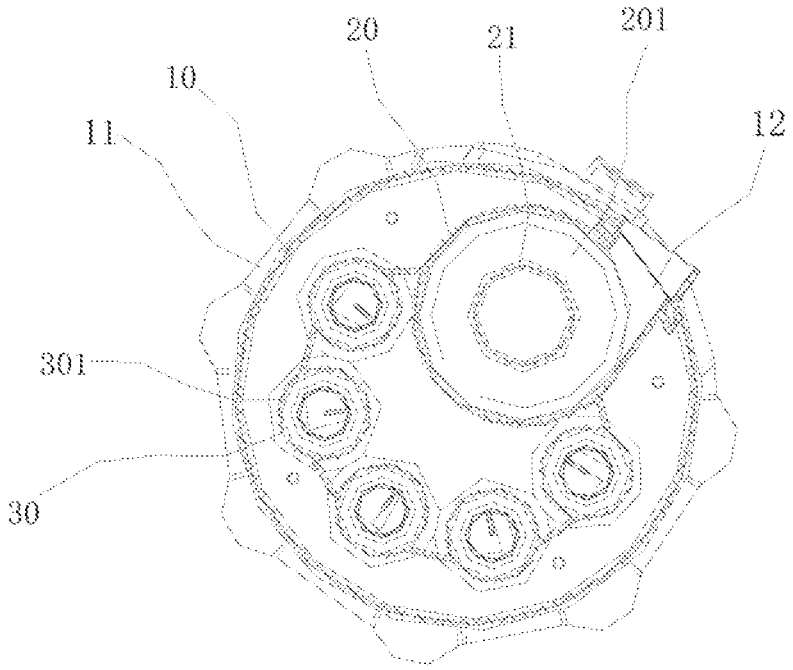
FIG. 4 is a section view of the cyclone separating apparatus along the B-B direction in FIG. 3.
Figure 5:
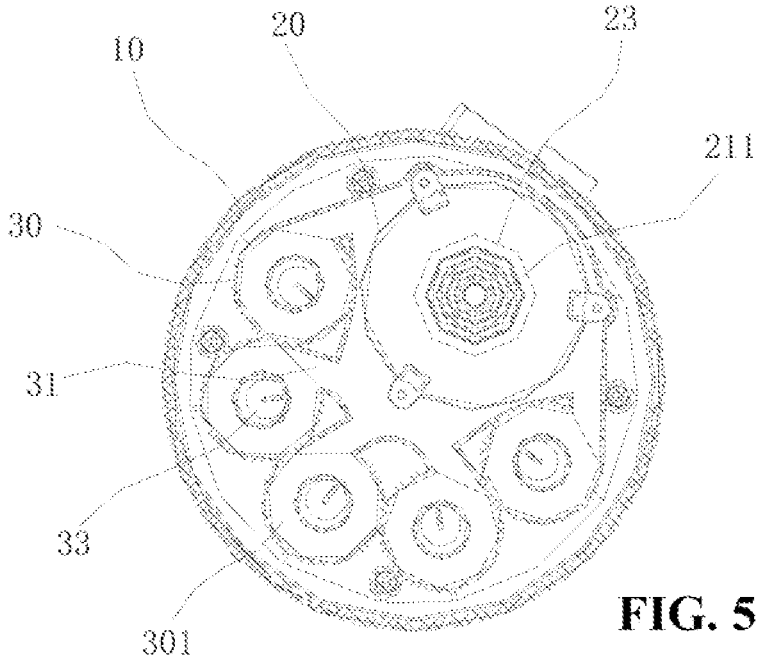
FIG. 5 is a section view of the cyclone separating apparatus along the C-C direction in FIG. 3.

As shown in FIGS. 4-5, in preferred embodiment, downstream cyclones 30 are multiple, the downstream air inlet 31 of each downstream cyclone 30 best locate at the same side of the upstream air outlet 23 near upstream cyclone 20 for distributing airflow on average as much as possible, i.e. the airflow exhaust from upstream cyclone 20 enter into each downstream cyclone 30 on overage as much as possible.

In some further embodiments, each downstream cyclone 30 is arranged along a circumferential direction whose axis coincided with the axis of the outer barrel 10, which makes the structure of separating apparatus more compact. Under this method, upstream cyclone 20 can arranges as shown in FIGS. 3-5, i.e. arranges deviation from the longitudinal axis of the outer barrel for arrange upstream cyclone 20 and multi downstream cyclone 30 as reasonable as possible.

We can see from FIG. 3, in this embodiment, the lower part of downstream cyclone 30 is cone which taper from top to bottom and the lower part of downstream cyclone 30 is arranged beside the upstream cyclone 20 while the upper part is located above the upstream cyclone 20. Taper-shape cyclone used in cyclone separating apparatus is very common, so the efficacy and advantages of it would not be descript in detail. While in spatial distribution, thinner parts of downstream cyclone 30 and upstream cyclone 20 arrange side by side and the thicker parts of downstream cyclone 30 arrange above the upstream cyclone 20, which makes the distribution of inner parts of the whole separating apparatus more reasonable and more compact.

As shown in FIG. 3, in some embodiments, the undersurface of downstream cyclone 30 can be inclined and it inclines downward from the near to the distant along the direction of the longitudinal axis of shielding cover 40. FIG. 3 draws a point line perpendicular to the under surface of downstream cyclone 30, there is an angle Q between the ling and under surface of downstream cyclone 30, and angle Q is greater than 0° and less than 90°, in some still embodiments, angle Q is greater than 45° and less than 60°. The inclination of the undersurface of downstream cyclone 30 is to make the downstream dust hole 32 incline, i.e. the small dust exhausted from downstream dust hole 32 incline and drop towards the longitudinal axis of shielding cover 40 for improving the dust separating efficiency.

It is to be noted, however, that the above embodiments are only given to illustrate the technical conception or technical features of the present invention, the aim is intended to enable a person skilled in the art to appreciate the content of the invention and further implement it, and thus the protecting scope of the invention can not be limited hereby. Also, any equivalent variations or modifications made according to the spirit of the invention should be covered within the protecting scope of the invention.

The invention claimed is:

1. A multi-cyclone separating apparatus of a vacuum cleaner, comprising:

an upstream cyclone having an upstream air outlet and an upstream separating chamber inside, an upper portion of the upstream separating chamber being connected with an air inlet passage;

at least one downstream cyclone, inside of which is formed a downstream separating chamber, each downstream cyclone having a downstream air inlet;

a downstream air outlet;

a lower part which forms a cone tapering from top to bottom, the lower part being arranged beside the upstream cyclone; and an upper part being located above the upstream cyclone;

an air passage formed between and connected with the upstream air outlet and the downstream air inlet;

an outer barrel, inside of which the upstream cyclone is located, an entrance of the air inlet passage being located at the outer barrel or extends outside of the outer barrel;

a shielding cover disposed within the outer barrel, inside of which is formed a secondary dust chamber;

a downstream dust hole set in a bottom of the at least one downstream cyclone, which is inside the shielding cover and connected with the secondary dust chamber;

a primary dust chamber formed between an outer wall of the shielding cover and an inner wall of the outer barrel; and a curved dust rejecting mouth, set in a bottom of the upstream cyclone, which is outside of the shielding cover entirely;

wherein the primary dust chamber is situated below and connected with the dust rejecting mouth, and each downstream cyclone has an inclined undersurface which inclines downward from near to distant to a longitudinal axis of shielding cover, which makes the downstream dust hole opened on said inclined undersurface incline towards the longitudinal axis of the secondary dust chamber, and wherein the shielding cover has an upper end which is connected to an undersurface of the upstream cyclone and an outer wall of the at least one downstream cyclone, and an inner space within which a lower part of the at least one downstream cyclone is located.

2. The multi-cyclone separating apparatus as claimed in claim 1, comprising a plurality of downstream cyclones, wherein the plurality of the at least one downstream cyclones is arranged along a circumferential whose axis is coincided with the axis of the outer barrel, while the axis of the upstream cyclone is at a distance away from the axis of the outer barrel.

3. The multi-cyclone separating apparatus as claimed in claim 1, wherein the curved dust rejecting mouth is arc-shaped, which is set near a side wall of the upstream cyclone along a circumferential direction thereof.

4. The multi-cyclone separating apparatus as claimed in claim 1, wherein there is an angle Q that is greater than 0° and less than 90° between a line perpendicular to an undersurface of the downstream cyclone and the longitudinal axis of the shielding cover.

5. The multi-cyclone separating apparatus as claimed in claim 1, wherein the angle Q is greater than 45° and less than 60°.

6. The multi-cyclone separating apparatus as claimed in claim 1, wherein the upstream cyclone has a hollow column in an interior of the upstream cyclone with a taper-shape grid, an inner chamber of the hollow column forming an upstream air-exhausting passage connected with the upstream air outlet.

* * * * *